US007749354B2

(12) United States Patent
Lawrence et al.

(10) Patent No.: US 7,749,354 B2
(45) Date of Patent: Jul. 6, 2010

(54) DIGESTER WASH EXTRACTION BY INDIVIDUAL SCREEN FLOW CONTROL

(75) Inventors: Dean K Lawrence, Hinton (CA); Wayne Hill, Springboro, OH (US); Stanislaus Leo Ludwig, Delta (CA); David R Code, Gibson (CA)

(73) Assignee: International Paper Company, Memphis, TN (US)

( * ) Notice: Subject to any disclaimer, the term of this patent is extended or adjusted under 35 U.S.C. 154(b) by 0 days.

(21) Appl. No.: 12/478,237

(22) Filed: Jun. 4, 2009

(65) Prior Publication Data

US 2009/0236059 A1 Sep. 24, 2009

Related U.S. Application Data

(60) Division of application No. 12/290,352, filed on Oct. 30, 2008, now Pat. No. 7,658,820, which is a continuation of application No. 10/854,123, filed on May 26, 2004, now Pat. No. 7,452,444.

(51) Int. Cl.
*D21C 7/14* (2006.01)

(52) U.S. Cl. ..... 162/48; 162/55; 162/246; 162/233

(58) Field of Classification Search ..... 162/48, 162/55, 246, 233
See application file for complete search history.

(56) References Cited

U.S. PATENT DOCUMENTS

| | | | |
|---|---|---|---|
| 5,401,361 | A | 3/1995 | Prough et al. |
| 5,489,363 | A | 2/1996 | Marcoccia et al. |
| 5,536,366 | A | 7/1996 | Marcoccia et al. |
| 5,547,012 | A | 8/1996 | Marcoccia et al. |
| 5,575,890 | A | 11/1996 | Prough et al. |
| 5,620,562 | A | 4/1997 | Marcoccia et al. |
| 5,635,026 | A | 6/1997 | Kettunen et al. |
| 5,662,775 | A | 9/1997 | Marcoccia et al. |
| 5,674,359 | A | 10/1997 | Chasse et al. |
| 5,691,922 | A | 11/1997 | McEwan et al. |
| 5,753,075 | A | 5/1998 | Stromberg et al. |
| 5,795,438 | A | 8/1998 | Stromberg et al. |
| 5,824,188 | A | 10/1998 | Prough et al. |
| 5,849,150 | A | 12/1998 | Marcoccia et al. |
| 5,849,151 | A | 12/1998 | Marcoccia et al. |
| 5,958,181 | A | 9/1999 | Stromberg et al. |
| 5,985,096 | A | 11/1999 | Marcoccia et al. |
| 6,086,712 | A | 7/2000 | Marcoccia et al. |
| 6,106,668 | A | 8/2000 | Stromberg et al. |
| 6,132,556 | A | 10/2000 | Stromberg et al. |
| 6,159,337 | A | 12/2000 | Marcoccia et al. |
| 6,169,761 | B1 | 1/2001 | Marcoccia et al. |
| 6,241,851 | B1 | 6/2001 | Marcoccia |
| 6,277,240 | B1 | 8/2001 | Marcoccia et al. |
| 6,280,568 | B1 | 8/2001 | Marcoccia et al. |
| 6,346,167 | B2 | 2/2002 | Marcoccia et al. |
| 2002/0069986 | A1 | 6/2002 | Marcoccia et al. |

FOREIGN PATENT DOCUMENTS

| | | |
|---|---|---|
| EP | 0937813 B1 | 8/1999 |
| SU | 1252415 A1 | 8/1980 |

OTHER PUBLICATIONS

Smart Filtrate Addition-Glens Falls Group offers a simple, low cost, high return modification for continuous cooking systems, Fiber and Pulp Industry, Jul. 2002.

New Filtrate Addition System results in Improved Digester performance, Gerry Pageau, BASc, PEng, MEng., p. 1-7.

*Primary Examiner*—Mark Halpern
(74) *Attorney, Agent, or Firm*—Matthew M. Eslami; Thomas W. Barnes, III

(57) ABSTRACT

A continuous digester comprises a wash zone having a plurality of individual wash screens disposed about an inner wall of the digester for the withdrawal of co-current downflow liquor from the wash zone. A conduit is connected in fluid communication between each of the wash screens and a collector for co-current downflow liquor withdrawn from the wash zone of the digester. A valve is interposed along the length of the conduit leading from each of the wash screens. The valve is operable between open and closed positions in response to a signal received from a temperature sensor associated with the conduit leading from each of the wash screens. The signal represent changes in temperature of a corresponding co-current down flow liquor through a corresponding conduit wherein a corresponding valve permits adjustment of a corresponding flow rate of liquor through said corresponding conduit to a flow rate that is substantially equal to each of the other flow rates of co-current downflow liquor through each of the other conduits.

7 Claims, 2 Drawing Sheets

DIGESTER WASH EXTRACTION BY INDIVIDUAL SCREEN FLOW CONTROL

CROSS-REFERENCE TO RELATED APPLICATIONS

This application is a divisional of U.S. patent application Ser. No. 12/290,352 filed Oct. 30, 2008, which in turn claims priority of U.S. application Ser. No. 10/854,123 filed May 26, 2004, the disclosure of which is incorporated herein by reference.

STATEMENT REGARDING FEDERALLY SPONSORED RESEARCH OR DEVELOPMENT

Not Applicable

FIELD OF INVENTION

This invention relates to continuous digesters for wood chips in the papermaking industry.

BACKGROUND OF INVENTION

As commonly practiced in the prior art relating to papermaking, wood chips and alkali liquor (white liquor) are pumped into the top of a hydraulic cooking vessel (digester, approximately 180 feet high and approximately 23 feet in diameter) that is operated at high pressure (165 psig) and temperature (325 degrees F.). A chip cooking process proceeds over the time that it takes the saturated chip column to move down through the digester where the discharge rate of the chips to a blow line at the bottom of the digester is matched to the feed rate at the top so as to maintain a constant level and retention time of the chips in the digester.

In the cooking process (delignification of wood chips), approximately 50% of the organic chip mass is dissolved in the cooking liquor. At 1 to 3 locations above the lower section of the digester, liquor containing the dissolved solids is removed from the vessel by extracting liquor through sets of screens in the circumferential wall of the digester, the screens being aligned with the inner wall of the digester vessel. The screens are 3 to 4 feet in height. The wash screens are the lowest (often the only) set of screens in a continuous digester and are located 10 to 20 feet up from the bottom of the digester. The screen plates are made from stainless steel with multiple slots cut in them that are 0.12 to 0.35 inch wide by 3 to 4 inches long depending on the location in the digester. The liquor that is extracted can be sent to a chemical recovery system where the liquor solids are concentrated and the organic solids burned in a chemical recovery boiler. The chemicals (inorganic solids) are recovered in the bottom of the recovery boiler and re-used to produce white liquor for the cooking process.

Just prior to discharge from the digester bottom, the chip mass is washed and cooled by cold (120 to 150 degrees F.) filtrate which is generated externally of the digester (from black liquor for example) and introduced into the wash zone of the digester. As much as possible remaining organic/inorganic material dissolved in the cooking liquor is removed from the chip column by a displacement and diffusion wash in the bottom of the digester by extraction of high-dissolved-solids hot liquor through the wash screens. To displace the high-solids hot liquor and to cool the chip mass, cooled black liquor filtrate is added to the bottom of the digester at several locations in the wash zone.

In some instances, some of the liquor extracted and/or a combination of lower solids liquors (black liquor and/or white liquor) is added to a center pipe (downcomer) in the digester that discharges in the center of the chip column adjacent to a given set of screens. The liquor added to the center pipe at least partially displaces the liquor being pulled through the extraction screens at such given set of screens.

In summary, the purpose of the wash screens is to remove high solids filtrate from the chip column as it passes these screens by the efficient displacement and diffusion wash with cooler and cleaner liquor added to counter wash nozzles, to ring dilution nozzles and/or to the center of the chip mass via a downcomer that discharges adjacent to these screens. The efficiency of the wash is measured by the extent to which there is maintained optimum low temperature of the chip mass discharged from the digester with concomitant minimization of the cooling of the wash liquor added to the wash zone.

Because of the nature of the compaction of the chip column, it is difficult to predict and/or control the uniform flow of re-circulation flows or free liquor upflows (i.e., counter-current) or downflows (i.e., co-current) through the chip mass in a large diameter continuous digester of the prior art. In the wash zone, there is a tendency for upflows to short circuit up the sides of the digester and for liquor contained in the chip mass to be carried co-currently down with the chip mass only to be displaced from the chip mass at the very bottom of the wash zone.

Temperature and alkali uniformity in the wash zone are impacted by flows at the bottom of the wash zone and in the wash zone of the digester. The temperature and alkali uniformity in the wash zone are key factors in achieving uniform cook (delignification) across the column. Uniform delignification reduces cellulose (pulp fiber) attack, helping to achieve overall maximum pulp fiber strength and yield. Cook non-uniformity across the column profile, with accompanying non-uniform retention of lignin on the individual fibers is a common deficiency of known prior art digesters.

As noted, in the prior art, The liquor added to the bottom of the chip mass passes through the chip column via paths of least resistance to the wash screens. The wash screens accommodate this process anomaly by removing the most easily removable flow to support the total wash screens flow. This results in poor displacement and diffusion of dissolved solids (poor wash efficiency) in the chip mass to the wash screens and poor heat transfer in some portions of the chip column. The poor wash efficiency causes downstream problems in the brown stock treatment and bleaching processes. The poor heat transfer in the chip column at the bottom of the digester increases the energy costs in these two affected process areas. Also, during operation, individual wash screens tend to plug off completely with the other screens picking up the flow. Continuous digesters are only shut down for maintenance on an annual basis, due to cost of such shutdowns. In some cases it has been observed that one or two wash screens will plug and remain plugged for the remainder of the year only to be unplugged during the annual shut down. The chip column adjacent to plugged wash screens leads to poor wash efficiency and poor heat transfer.

Thus, the prior art is deficient in that:

1. The flow through each of the wash screens is variable and dependent on the path of least resistance flow of wash filtrate added to the bottom of the digester. This is observed physically by the wide variance in wash screen exit nozzle temperatures.
2. There is no known current method to control the individual wash screen flow and temperature in order to break up the pattern of path of least resistance flow of cold blow wash filtrate. Further, there is currently no known method to unplug the wash screens other than when the digester is empty during the annual shut down.

3. The upflow through the wash zone is operated at higher than optimum for alkali and temperature profile uniformity because of the current inability to manage and maintain an acceptable wash efficiency in the bottom of the digester.
4. There is no known current method for adjusting the amount of free liquor upflow through the wash zone in order to maintain uniformity of temperature and alkali in the wash zone where the highest percentage of the cook (time at temperature) is completed with the highest potential for product non-uniformity to be affected. Currently, in the prior art, a higher free liquor upflow is maintained in order to compensate for the non-uniformity of the operation of the wash screens. Whereas this higher free liquor upflow helps to manage the dissolved solids level in the digester discharge, such flow has a negative impact on the temperature and alkali profiles in the wash zone.

SUMMARY OF INVENTION

In accordance with one aspect of the present invention, the total volume of liquor withdrawn from the digester through the wash screens within the wash zone of the digester is uniformly and automatically distributed between all of the wash screens. To this end, in accordance with the present invention there are installed individual temperature measurement, flow measurement and flow control valves in association with each of the wash screen to control the flow through such wash screen to maximize energy and wash efficiency. Further, this feature provides for sensing of a screen in difficulty and individual isolation of a screen by closing it's flow control valve to allow the down flowing chip column to wipe a screen thereby cleaning and avoiding total plugging of the screen as occurs in the prior art.

Additionally, in the present invention, there is provided a central downcomer within the digester. This downcomer includes side discharge ports adjacent to the bottom end of the downcomer through which filtrate liquor is discharged into the digester. These discharge ports of the downcomer are disposed substantially radially of the surrounding wash screens such that the discharge streams of filtrate liquor from the ports are directed substantially radially toward the surrounding screens, thereby creating a layer of filtrate liquor flowing perpendicularly from the center of the digester toward all the screens. This flow pattern of liquor filtrate is directed across the downward flow of the chip mass and has been found to break up or discourage formation of upflow/downflow streams of filtrate liquor within the area of the screens.

As desired, the piping associated with the wash screens may be provided with automatic or manual back flush apparatus to allow reverse flow of filtrate through the screens to assist in clearing a screen that is showing signs of plugging.

Still further, in accordance with one aspect of the present invention the present inventors have found that reducing the wash zone free liquor upflow (i.e., counter-current) or establish a free liquid downflow (i.e., co-current) (as for example a free liquor upflow of from about the current 0.25 gpm/ADt/d (US gallons per minute per air dry tonne per day to a 0.007 gpm/ADt/d of free liquor upflow, i.e., counter-current or downflow, i.e., co-current)), provides improved uniformity of the product leaving the wash zone.

BRIEF DESCRIPTION OF THE DRAWINGS

The foregoing, as well as other objects and advantages of the invention will become apparent from the following detailed description when taken in conjunction with the accompanying drawings, wherein like reference characters designate like parts throughout the several views, and wherein.

DETAILED DESCRIPTION OF INVENTION

Figure 1:
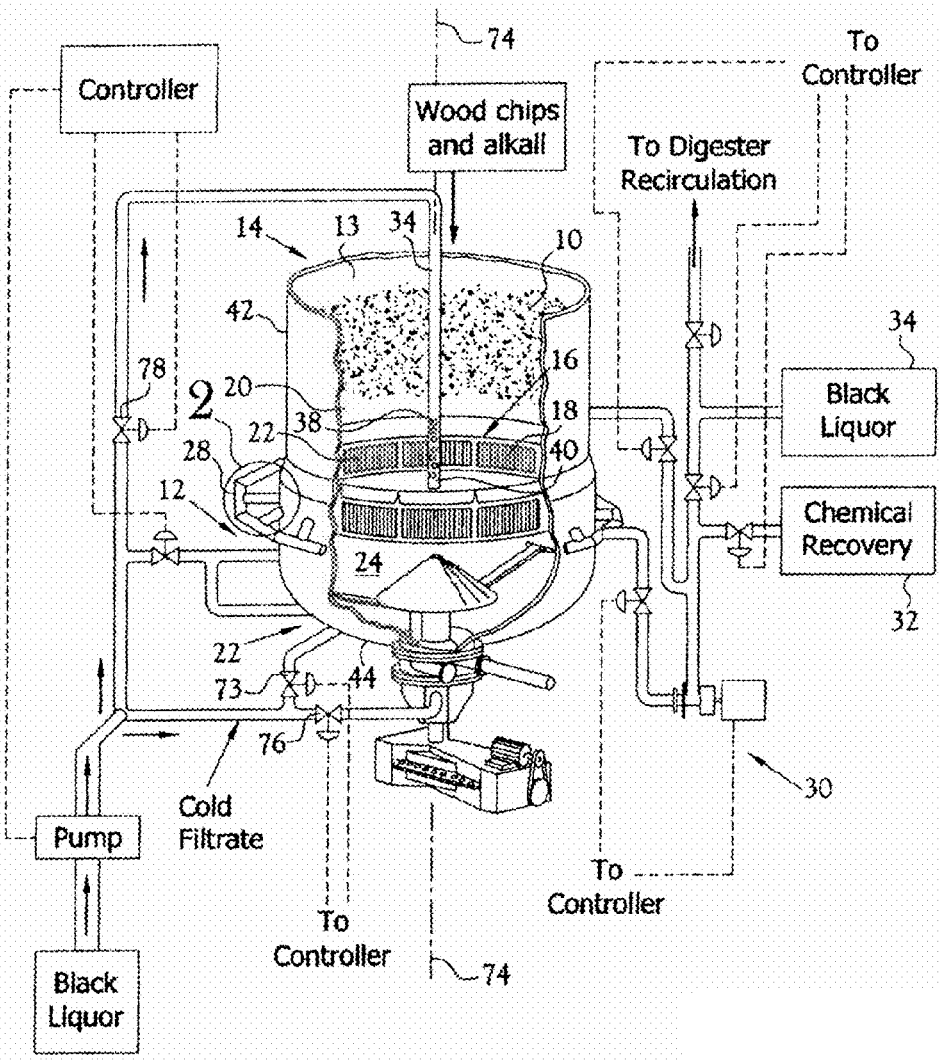
FIG. 1 is a schematic representation of a typical wood chip digester embodying various of the features of the present invention.

In the embodiment of the present invention depicted in FIGS. 1 and 2, as noted hereinabove, approximately 50% of the organic chip mass 10 is dissolved in the looking liquor. The depicted digester 14 includes an upper zone 13 into which the chip mass is loaded. This is also the cooking zone. A set 16 of screens, twelve screens 18 in a typical embodiment, are disposed about the inner circumferential wall 20 of the digester at a location just below the cooking zone 13 and above a wash zone 24 which is disposed at the bottom end of the digester.

Liquor containing dissolved solids is extracted from the interior of the digester through the screens. The liquor extracted through the individual screens is conveyed to a discharge header 28 which encircles the girth of the digester externally of the digester in the region of the screens and is conveyed, as by a pump system 30, to a chemical recovery station 32 or is selectively returned in part to the digester via a downcomer 54. As desired, a heater may be interposed within the piping between the pump station and the downcomer to heat the filtrate prior to its return to the digester. The downcomer is located centrally of the digester and includes discharge ports 38 adjacent the lowermost end of the downcomer. As depicted in FIG. 1, these ports are disposed substantially radially equidistant from the surrounding screens such that the filtrate liquor discharged through the ports is directed substantially radially outwardly (see arrows of FIG. 1) from the downcomer ports thereby ensuring that the filtrate liquor discharged from the downcomer flows simultaneously and substantially uniformly radially toward all of the screens. When the filtrate liquor discharged into the chip mass adjacent the wash screens is heated to about the cook filtrate liquor temperature, and by reason of the radially lateral flow of the discharge filtrate liquor, upflow or downflow of the liquor through the chip mass in the area of the screens is prevented or discouraged.

As needed or desired, black liquor from one or more known sources in a papermaking facility may be added to the filtrate liquor which is extracted from the screens and fed to the downcomer.

In the depicted digester, there is provided a single set 16 of wash screens includes multiple separate screens 18 covering the digester circumference. As noted, these screens serve to permit the withdrawal of hot liquor containing dissolved organic/inorganic solids from the digester for reuse or recovery of the individual components of the extracted filtrate. In accordance with one aspect of the present invention, and referring to FIGS. 1 and 2, conveyance of extracted filtrate from each screen 18 is effected by means of a stub pipe 26 disposed behind each screen 18 and serves to accept the liquor extracted from the digester by the screen and to convey the same away from the screen. This stub pipe is in fluid flow communication with a discharge ring header 28 which encircles the digester outside of and along the outer wall 42 of the digester and which serves to convey the filtrate from the several screens to a pump station.

Figure 2:
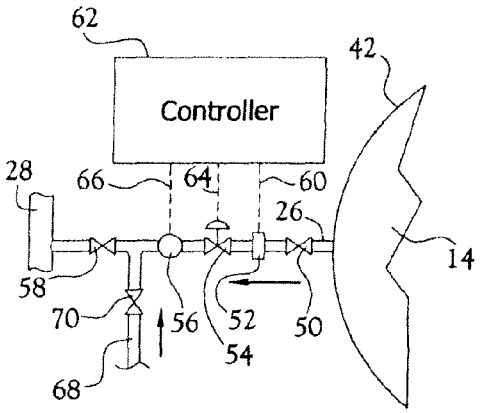
FIG. 2 is a schematic representation of a portion of the digester depicted in FIG. 1 and taken along the circle 2 of FIG. 1.
Figure 4:
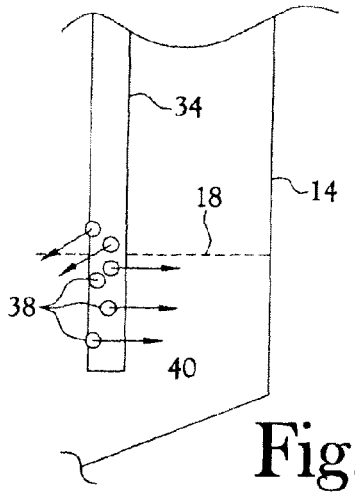
FIG. 4 is detailed side view of the distal end of a downcomer as depicted in FIG. 1.
Figure 3:
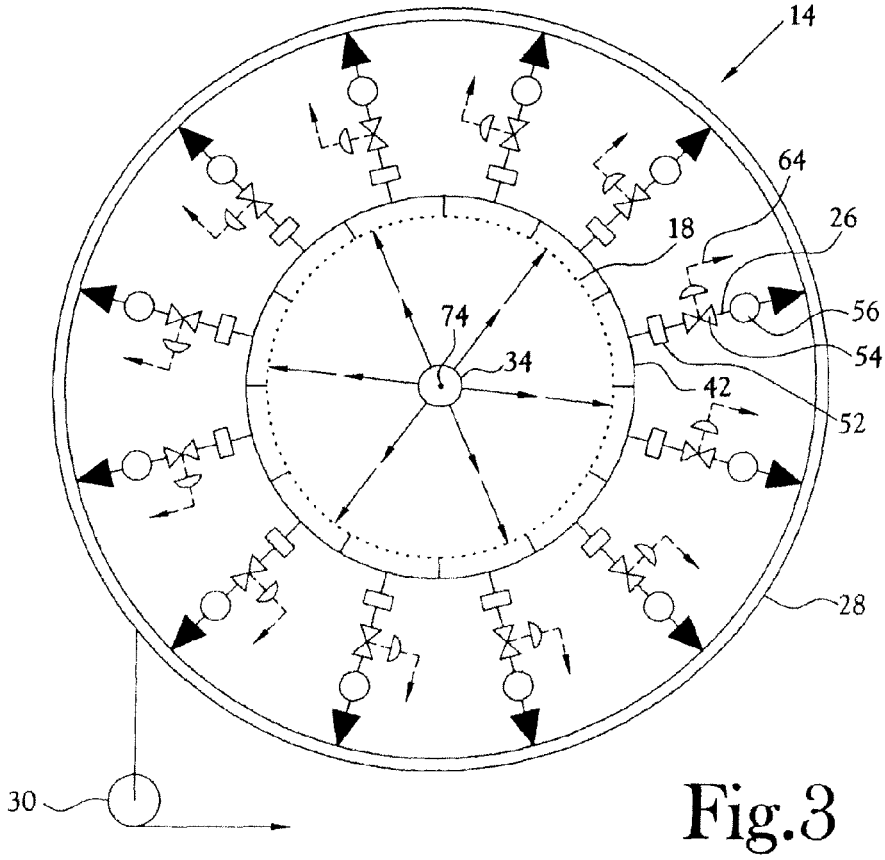
FIG. 3 is a schematic representation of various piping elements and flow directions of fluids into the digester from a downcomer and out of the digester via control elements associated with the present invention.

With specific reference to FIGS. 2 and 3, in accordance with the present invention, a continuous digester 14 having a set 16 of screens 18 disposed about its inner circumference 20 for withdrawal from the digester through the screen solids-bearing hot liquor, is provided with a combination of elements associated with the stub pipe 26 which is in fluid communication between each screen and a generally circular discharge collection header 28 disposed externally about the outer circumference of the digester. In the depicted embodiment of the invention, these elements are interposed along the length of the stub pipe and between the outer wall of the digester and the header. Each such combination of elements includes a first manual valve 50 located adjacent the digester outer wall, a temperature sensor 52 next to the first manual valve, an electronically controlled valve 54 next to the temperature sensor, a flowmeter 56 next to the electronically controlled valve, and a second manually operated valve 58 adjacent the header. As seen in FIG. 1, the header is in fluid communication with a pump 30 which functions to draw the hot liquor extracted by each screen through the header to remote locations such as a chemical recovery station 32, etc.

FIG. 3 schematically depicts the combination of elements referenced above and shows the association of a combination of elements associated with each individual screen. In this FIG. 3, the valves associated with back wash of each screen, as seen in FIG. 2, have been omitted for purposes of clarity.

In the present invention, hot liquor extracted from the digester through a given screen flows through the combination of elements which are interposed between the digester and the header. In the depicted embodiment, the discharge flow of hot liquor initially encounters the first manual valve 50. This valve is manually operable to provide a means for manually adjusting the outflow from a given screen to either full flow, partial flow, or no flow. Next in line, the discharge flow encounters the temperature sensor 52 which includes an electrical lead 60 that passes to a controller 62. Next in line, the discharge flow encounters the electronically controlled valve 54 having an electrical lead 64 that passes to the controller. Next in line, the discharge flow encounters the flowmeter 56 which also includes an electrical lead 66 which passes to the controller. Finally in line, the discharge flow encounters the second manually operated valve 58 and then flows into the header 28. In the depicted embodiment there is provided a conduit 68 which intersects the stub pipe at a location between the flowmeter and the second manual valve. This conduit is provided with a third manually operated valve 70.

Operationally, the first manually operated valve 50 functions to allow manual control over the flow through the stub pipe (irrespective of direction of flow) as either full flow, partial flow or no flow. Thus, this first valve functions as a type of override to any automatic control over the flow between the digester and the header, and in a backwash situation to assist in the flow control of backwash liquid to a screen. For back washing of a screen, the automatic control of the flow of discharge liquor from the screen toward the header is deactivated (as by the controller), the second manual valve 58 is closed to close off all flow to the header, and the third valve 70 is opened to admit backwash liquid into the stub pipe, thence to the screen at a flow rate which can be selected by either or both of the first and third manual valves.

During normal operation of the digester, with the second and third manual valves closed, and the first manual valve open, the outflow of hot liquor through each of the screens of the set of screens is selected automatically via the controller. Specifically, as hot liquor is withdrawn through a given screen, under the influence of the pump 30, this discharge liquor encounters the temperature sensor 52 which senses the temperature of the discharge flow and develops an electrical signal which is representative of such flow and transmits such signal to the controller. Like signals representative of the temperature of the discharge flow from each of the screens are fed into the controller where these temperatures are compared to one another and to a temperature which is representative of the desired flow from each screen and which serves as a standard against which each of the discharge flows of each of the screens is compared. Variations in the temperature of the discharge flow from a given screen from the standard temperature are indicative, first, of the existence of flow from the screen, and, second, of the possible existence of cool upflow liquor from the wash zone reaching the screen without passing through the chip mass as a disbursed stream.

After the discharge flow passes the temperature sensor, it encounters the electronically controlled valve 54 which functions to adjust the rate of discharge flow to a value which is determined by the controller.

Downstream of the electronically controlled valve, the discharge flow encounters the flowmeter whose function is to sense the rate of flow of the discharge liquor through the stub pipe, generate an electrical signal representative of the sensed rate of flow and transmit such signal to the controller via the electrical lead 66.

From the foregoing, it will be evident that if a screen is fully plugged, all flow of hot liquor through the screen will be halted. In this event, the there is no flowing hot liquor to contribute to the temperature sensed by the temperature sensor so this sensor will report to the controller a relatively cool temperature. Within the controller this cooler temperature will be compared to the normal hot liquor temperature, or other set temperature, and generate a signal to the operator to alert the operator to this undesirable condition. Likewise, the flowmeter will signal the controller that there is no flow through the stub pipe, this condition also possibly being the result of a plugged screen. In the present system, to avoid actual full plugging of a screen, the controller may be set to alert the operator when there is only a small drop in the temperature of hot liquor and/or small drop in the flow rate of the hot liquor passing through the stub pipe so that the operator may take remedial action immediately to remedy the plugging of the screen. This combination of a reduction in the anticipated flow rate through a stub pipe as sensed by the flowmeter which also sends to the controller a signal representative of such reduced flow to the controller, with the sensed reduction in temperature of the flowing hot liquor provides a novel improved concept for monitoring the operability of each individual screen. Thus, the signal from the flowmeter provides the controller with a signal, which compliments the signal to the controller from the temperature sensor.

In like manner, if the temperature within the stub pipe is within a range recognized by the controller as acceptable, but the flow rate of hot liquor through a given stub pipe increases above a standard value set in the controller, such conditions may indicate that more than anticipated hot liquor is flowing through the given stub pipe. This condition can be indicative of the lack of contribution to the overall desired discharge rate of hot liquor from the digester by one or more of the other screens, for example, and an alert to the operator to at least investigate the digester operating conditions and, if needed, take remedial action. Thus, it is seen that the combination of the temperature sensor and the flow meter are essential to the successful functioning of the present invention.

Further, if the rate of flow of hot liquor through the stub pipe is within a range set in the controller, but the temperature of the flow of hot liquor is lower than anticipated, such condition may be indicative of relative cool wash liquor moving upwardly of the digester into the area of the screens, such flow of cool wash water being possibly due to too much wash water being added to the bottom end of the digester or the existence of excess upflow of the wash liquor to a given screen or screens.

Other combinations of sensed temperature and independently sensed flow rate may be indicative of other operating conditions within the digester which may call for operator interdiction. For example, since the flow of hot liquor from each screen is monitored, both for temperature and flow rate, independently of every other screen, it may be readily determined if one or more screens is not functioning as desired, and importantly, which one or more screens is involved, thereby localizing a malfunction within the digester.

The present invention provides prompt and early indication of a source of possible trouble with respect to the outflow of hot liquor from the digester. In this respect, if a given screen or screens is noted to be plugging, the operator can close down outflow from such screen or screens, thereby allowing the downflowing chip stream to sweep the surface of the screen interiorly of the digester and remove all or part of any material which is attempting to plug the screen or screens. If this technique is unsuccessful, the operator further has the option of back washing the screen or screens individually employing the first, second and third manually operable valve which are associated with the stub pipe of each screen.

In accordance with one aspect of the present invention, hot liquor withdrawn from the digester through the screens and after being subjected to chemical recovery, is reintroduced to the interior of the digester through the downcomer which is aligned with the vertical centerline 74. In the present invention, contrary to the prior art, the discharge ports in the bottom end of the downcomer are disposed both centrally of the interior of the digester and radially aligned with the screens which surround the downcomer. In this manner, the present inventors provide for the injection into the chip mass of a substantially circular sheet of fresh hot liquor which flows from the downcomer ports radially toward the screens. This flowing sheet of hot liquor has been found to eliminate or substantially discourage the development of upflows or downflows within the chip mass at substantially all points radially between the downcomer and the screens in the digester wall. This effect has been particularly noted in the regions of the perpendicular cross-section of the digester at the level of the screens and adjacent the screens for reasons not fully understood.

In addition to the recycling of treated hot liquor which has been withdrawn from the digester via the discharge header and fed back into the digester via the downcomer, cold filtrate (below the cooking temperature of the chip mass in the digester) from black liquor sources common in a papermaking facility, may be introduced into the bottom end of the digester as wash liquor as by a pump and associated piping as is known in the art. As desired or needed, such black liquor may be added to the digester through the downcomer, either as a substitute for hot liquor from the chemical recovery station or as an additive to the hot liquor from the recovery station.

Control over the flow of black liquor into the digester may be controlled through the controller, and a plurality of electrically operable valves, such as valves 73, 76 and 78. Each of these, and all others of the electrically operable valves includes a respective electrical lead between the controller and each such valve. In the Figures, the electrical leads from these and others of the electrically responsive elements are indicated in dashed lines for purposes of clarity, but in all instances these electrical leads extend between the respective valve or element and the controller.

What is claimed is:

1. A method for washing co-current downflow wood chips in a hot liquor in a digester having an upper zone and a lower wash zone, the co-current downflow wood chips and hot liquid defining a chip mass which flows from the upper zone through the wash zone of the digester, the method comprising:

maintaining outflow of co-current downflow hot liquor from the digester through a plurality of screens disposed about the inner circumference of the digester at a location intermediate the upper zone and the wash zone of the digester;

monitoring temperature of the outflow of co-current down flow hot liquor through each of the plurality of screens;

measuring the temperature of the outflow of co-current down flow hot liquor through each of the plurality of screens with the temperature of the outflow of hot liquor through each other of the plurality of screens; and adjusting a corresponding flow rate of the outflow of co-current downflow hot liquor through one or more of the screens bringing the rate of outflow of hot liquor from each of the screens to substantially the same rate of outflow of hot liquor as others of the screens or reducing the rate of outflow of hot liquor through one or more of the screens to a value which permits downflow of hot liquor past the one or more of the screens to sweep the one or more of the screens substantially free of solid material wherein the solid material having a tendency to plug the one or more of the screens from permitting the outflow or hot liquor flow through said one or more screens.

2. The method of claim 1 and including simultaneously introducing downflow wash liquor into the digester from a plurality of ports oriented to discharge the wash liquor therefrom radially from the approximate center of the digester and toward the screens thereby preventing the development of downflow streams of liquor independently of the overall downflow of the chip mass from the upper zone to the wash zone of the digester.

3. The method of claim 2 wherein the downflow wash liquor admitted to the digester through the ports is heated to a temperature substantially equal to the temperature of the hot liquor disposed within the upper zone of the digester.

4. A method for enhancing the wash efficiency of a digester for wood chips disposed in a co-current downflow hot liquor, the digester having at least an upper zone and a lower wash zone and a plurality of screens disposed about the circumference of the digester at a location intermediate the upper zone and lower wash zone, the method comprising the steps of:

introducing a wood chips and hot alkali liquor into the upper zone of the digester to define a chip mass which flows from the upper zone to the wash zone of the digester;

withdrawing co-current downflow hot liquor from the chip mass through individual ones of the plurality of screens conveying the withdrawn hot liquor away from the digester;

measuring temperature of outflow of co-current downflow hot liquor through each of the screens and adjusting the temperature of hot liquor withdrawn through each of the screens to a temperature value which is substantially equal to the temperature of hot liquor withdrawn through each of the others of the plurality of screens, or to a temperature value which reduces or substantially fully stops the withdrawal of hot liquor through one or more of the screens; and simultaneously introducing cool wash liquor into the wash zone of the digester in counterflow to the downward flow of the chip mass through the digester, the inflow quantity of wash liquor being substantially equal to the overall quantity of hot liquor withdrawn from the digester through the plurality of screens.

5. The method of claim 4 further comprising of measuring flow rate of outflow of co-current downflow hot liquor through each of the screens and adjusting the flow rate of hot liquor withdrawn through each of the screens to a flow rate value which is substantially equal to the flow rate of hot liquor withdrawn through each of the others of the plurality of screens, or to a flow rate value which reduces or substantially fully stops the withdrawal of hot liquor through one or more of the screens.

6. The method of claim 4 and including the step of introducing a quantity of downflow wash liquor in a flow direction generally radially into the digester from a plurality of ports disposed centrally of the digester whereby the quantity of wash liquor flows substantially equally radially outwardly toward the plurality of screens thereby discouraging the development of flow paths of wash liquor moving independent of the flow of the chip mass.

7. The method of claim 4 and including the step of closing off the withdrawal of downflow hot liquor from one or more of the screens when the temperature of the hot liquor being withdrawn from the digester by the one or more of the screens is sufficiently cooler than the temperature of others of the screens wherein the difference in temperatures being indicative of plugging of the one or more of the screens, thereby permitting the flow of the chip mass past the one or more of the screens to sweep the one or more of the screens and thereby wipe from the one or more screens solid material tending to plug the one or more screens.

* * * * *